US005222829A

United States Patent [19]

Mogler et al.

[11] Patent Number: 5,222,829

[45] Date of Patent: Jun. 29, 1993

[54] SCREED ASSEMBLY FOR AN ASPHALT PAVING MACHINE

[75] Inventors: Jay A. Mogler, Elk River, Minn.; Wade D. Samson, Sycamore; Keith R. Schmidt, Clare, both of Ill.

[73] Assignee: Caterpillar Paving Products Inc., Minneapolis, Minn.

[21] Appl. No.: 850,608

[22] Filed: Mar. 13, 1992

[51] Int. Cl.[5] ..... E01C 19/22

[52] U.S. Cl. ..... 404/118

[58] Field of Search ..... 404/118, 119

[56] References Cited

U.S. PATENT DOCUMENTS

| | | | |
|---|---|---|---|
| 4,272,213 | 6/1981 | McGovarin | 404/118 |
| 4,345,852 | 8/1982 | Goto et al. | 404/118 X |
| 4,379,653 | 4/1983 | Brown | 404/118 |
| 4,702,642 | 10/1987 | Magil | 404/118 |
| 4,969,773 | 11/1990 | Heims | 404/118 |
| 4,986,695 | 1/1991 | Heims | 404/118 |
| 4,991,995 | 2/1991 | Heims | 404/118 |

*Primary Examiner*—William P. Neuder

*Attorney, Agent, or Firm*—Robert A. McFall

[57] ABSTRACT

In accordance with one aspect of the present invention, a modular screed assembly attachment for an asphalt paving machine having a main screed unit, includes a support assembly that is detachably connectable to the main screed unit, a movable carriage slidably mounted on the support assembly, and a platform assembly movably connected to the movable carriage. The modular screed assembly attachment also includes means for moving the carriage between a position adjacent the main screed unit and a position spaced from the main screed unit, and means for selectively positioning the platform assembly elevationally with respect to the carriage.

15 Claims, 3 Drawing Sheets

SCREED ASSEMBLY FOR AN ASPHALT PAVING MACHINE

DESCRIPTION

1. Technical Field

This invention relates generally to a screed assembly for an asphalt paving machine, and more particularly to a screed assembly having at least one laterally moveable member that is extendable to vary the effective width of the screed.

2. Background Art

Variable width screeds for asphalt paving machines are well known. Generally, variable width screeds comprise a main screed unit having a fixed width, and one or more extendable units attached to the main unit. Extendable screeds that can be elevationally adjusted independently of the main screed unit have been proposed. U.S. Pat. Nos. 4,379,653 issued Apr. 12, 1983 to Robert L. Brown, and 4,702,642 issued Oct. 27, 1987 to Joseph E. Musil disclose screed assemblies in which the frames of the extendable members are adjustably attached, elevationally, to the main screed unit. In these arrangements, the entire extendable assembly, including frame members, are moved elevationally to vary the slope and elevation of the material contacting screed plate. Therefore, the attachment between the main and extendable units must be vertically adjustable. Because of this requirement, the rigidity of the collective assembly is compromised making it difficult to maintain a predetermined elevational position of the extendable unit.

Further, such arrangements require a multitude of mechanically operated mechanisms, such as crank operated screw jacks, mounted on the main frame and attached to the frame members of the extendable units. These mechanical adjustment devices are cumbersome to operate and difficult to coordinate for simultaneous movement. For example, in the prior art arrangements, it is virtually impossible to move the frame of the extendable screed unit laterally to vary paving width and simultaneously adjust the elevational position of the extendable units, base plate to maintain a predetermined grade or elevation, slope, and intercept point with the outer edge of the main screed.

Furthermore, since the adjustment systems for varying the extension and elevational position of the extendable members are mounted on, or attached directly to, the main screed unit, it is impractical to detach the extendable members for service apart from the entire screed assembly, or to convert the main screed unit for use as a single member, fixed width screed.

The present invention is directed to overcoming the problems set forth above. It is desirable to have an extendable screed assembly having a frame that is laterally movable but elevationally fixed with respect to the frame of the main screed unit. Further it is desirable to have such an extendable screed assembly wherein only its screed plate and associated support structure are elevationally movable simultaneously with extension or retraction of the extendable screed assembly. It is also desirable to have such an extendable screed assembly wherein the extendable member is readily removable, as a self-contained module, from the main screed unit.

DISCLOSURE OF THE INVENTION

In accordance with one aspect of the present invention a modular screed assembly attachment for an asphalt paving machine having a main screed unit includes a support assembly detachably connectable to the main screed unit, a movable carriage slidably mounted on the support assembly, and a platform assembly movably connected to the movable carriage. The modular screed assembly attachment also includes means for moving the carriage between a position adjacent the main screed unit and a position spaced from the main screed unit, and means for selectively positioning the platform assembly elevationally with respect to the carriage.

In another aspect of the present invention, a screed assembly for an asphalt paving machine includes a main screed unit and a pair of modular screed units. Each of the modular screed units have a support assembly detachably connected to the main screed unit, a movable carriage slidably mounted in the support assembly, a platform assembly moveable connected to the carriage, means for moving the movable carriage and means for selectively positioning the platform assembly elevationally with respect to the carriage.

Other features of the modular screed assembly attachment include a platform assembly having a deck member and a screed plate wherein the screed plate is detachably connected in vibration isolating relationship to the deck member.

BEST MODE FOR CARRYING OUT THE INVENTION

Figure 1:
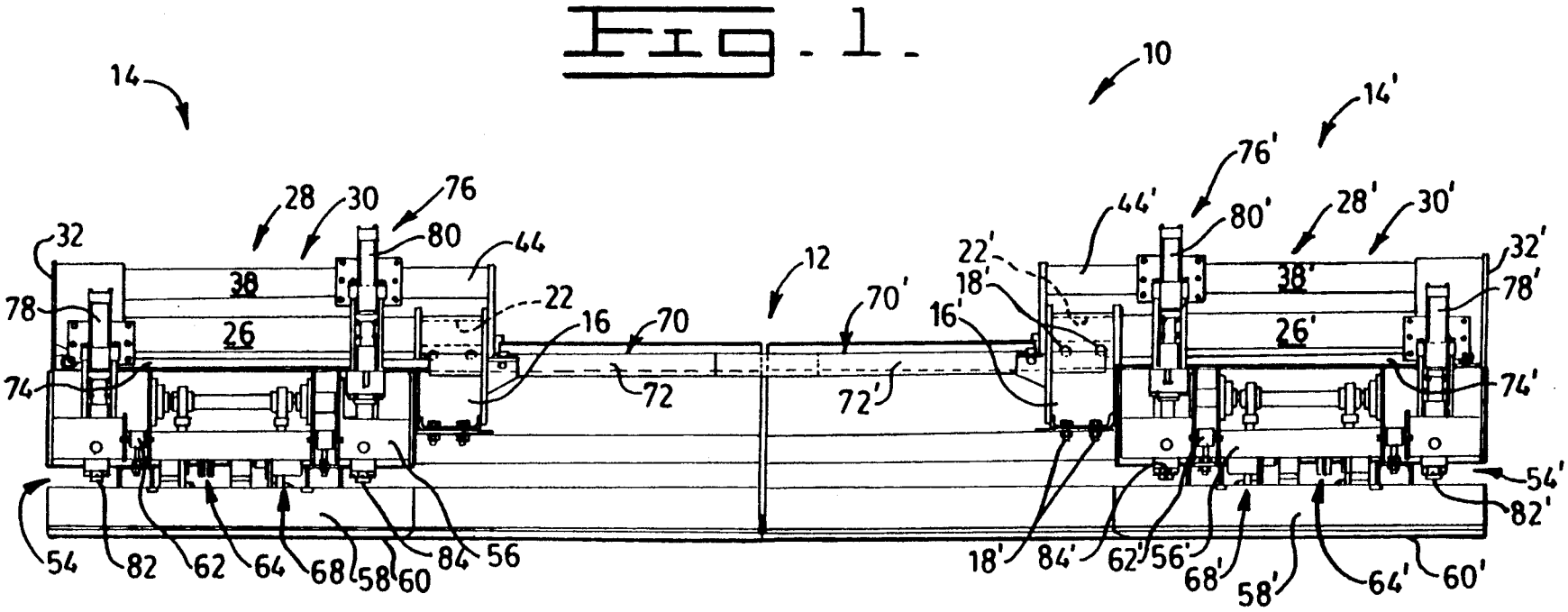
FIG. 1 is a rear elevational view of a screed, for an asphalt paving machine, embodying the present invention.
Figure 2:
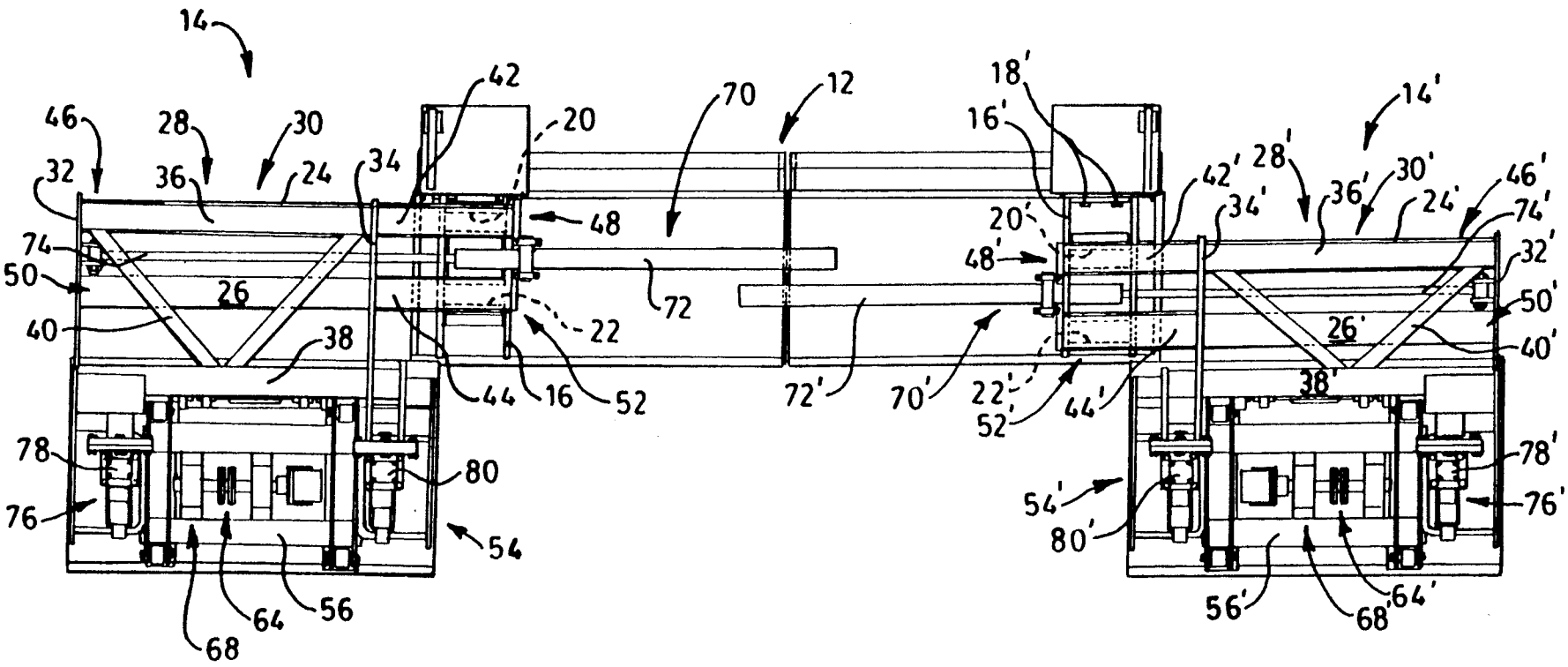
FIG. 2 is a top plan view of a screed, for an asphalt paving machine, embodying the present invention; and, FIG. 3 is an end view, as viewed from the right hand side of FIGS. 1 and 2, of a screed, for an asphalt paving machine, embodying the present invention.
Figure 3:
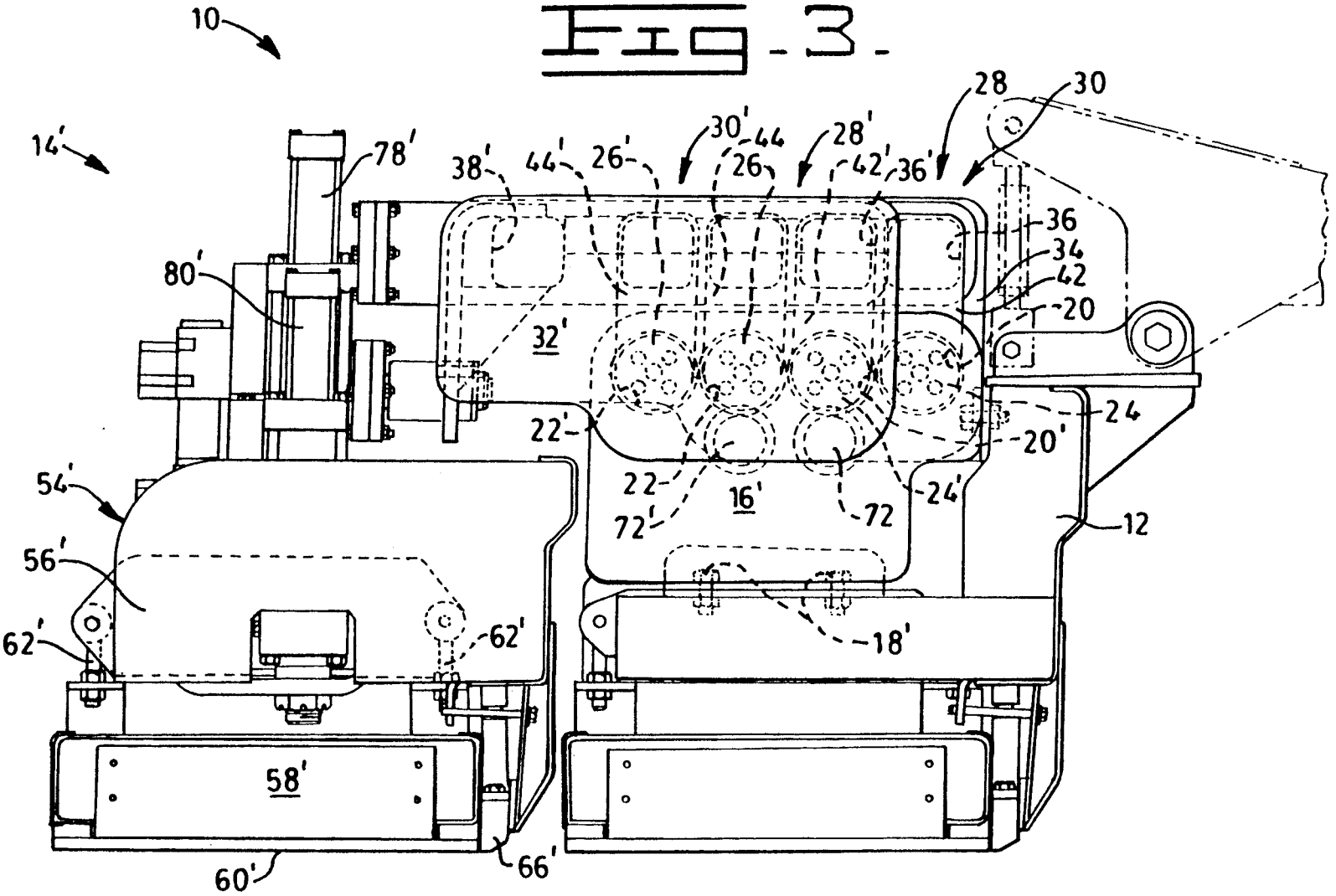

With reference to FIGS. 1-3, a screed assembly 10, for an asphalt paving machine, includes a main screed unit 12 and a pair of extendable modular screed units 14,14'. The extendable screed units 14,14' are substantially identical in construction except for the reversal of certain parts. For the sake of clarity the elements of the right hand unit, as oriented in FIGS. 1 and 2, are identified as a prime (') of the corresponding element of the left hand unit. The main screed unit 12 is of conventional construction and, although not shown, typically has a mechanism for providing a crown, or break, in the slope of the screed plate carried by the main screed unit. Furthermore, the main screed unit 12 of conventional construction typically has means for heating and vibrating the main screed plate. Again, in the interest of clarity, these well known elements have been omitted from the drawings.

Each of the modular screed assemblies 14,14' are adapted to be mounted on the main screed unit 12 as attachments and, as will described below in more detail, may be removed from the main screed unit for service. Removal of the modular screed assemblies will not affect the operation of the main screed unit which may be used by itself as a fixed width screed.

In the preferred embodiment of the present invention, the modular screed assemblies 14,14' each have a support assembly 16,16' that is fixedly attached to the main frame 12 by removable fasteners, such as bolts 18,18'. Each of the support assemblies 16,16' have a pair of internal surfaces defining first and second bores, 20,20' and 22,22' respectively. Each of the bores 20,20',22,22' are adapted to slidably receive, as described below, a respective guide member 24,24'26,26'.

Each of the modular screed assemblies 14,14' also have a movable carriage 28,28' that is slidably mounted on the support assembly 16,16'. Each movable carriage 28,28' has a frame 30,30' that is a welded assembly of structural members composed of a pair of spaced apart end members 32,32',34,34', forward and rear tubular beams 36,36',38,38' extending between the end members, and cross braces 40,40' extending between the forward and rear tubular beams. The outer end member 32,32' is essentially a flat plate forming an end wall of the frame whereas the inner end member 34,34' comprises both a plate and a pair of extended support arms 42,42',44,44' that are aligned with the first and second bores 20,20',22,22' of the support assembly 16,16'.

As best shown in FIGS. 2 and 3, the extended support arms 42,44 comprising a portion of the frame 30 of the left hand modular screed assembly 14 are horizontally offset from the extended support arms 42,44' of the right hand modular screed assembly 14' to avoid interference between the respective frame elements when the modular screeds are retracted, or drawn toward each other. The tubular guide members 24,24',26,26' have a machined outer surface, the diameter of which is only slightly less than the diameter of the bores 20,20',22,22' in the support assemblies 16,16'. The guide members are thus slidably supported by the bores so that they may move longitudinally along a centrally disposed axis of the tubes, but are restricted from any lateral or transverse movement. Further, the forwardly positioned tubular guide members 24,24' each have respective spaced apart outer end portions 46,46' and inner end portions 48,48', and the rearwardly positioned tubular guide members 26,26' each have spaced apart outer end portions 50,50' and inner end portions 52,52'. The outer end portions 46,46',50,50' of the tubular guide members 24,24',26,26' are attached to a respective one of the outer end members 32,32', and the inner end portions 48,48'52,52' are attached to a respective one of the extended support arms 42,42',44,44', preferably by bolts.

Each of the modular screed assemblies 14,14' also have a platform assembly 54,54' that is movably connected, as will be explained below, to a respective movable carriage 28,28'. The platform assemblies 54,54' each have a deck member 56,56' and a screed plate assembly 58,58'. The screed plate assemblies 58,58' each have a lower plate, which on its bottom, or outer surface, has a material contacting surface 60,60'. As best shown in FIG. 3, each of the screed plate assemblies 58,58' are detachably connected in vibration isolating relationship to its respective deck member 56,56' by threaded hangers 62,62'. The threaded hangers have rubber bushings at an upper end and are pivotally attached to the respective deck member 56,56' at their upper end by pins extending through the rubber bushing. Desirably, the left screed plate assembly 58 and the right screed plate assembly 58' are constructed so that they are reversibly interchangeable with each other.

In the preferred embodiment of the present invention, each of the platform assemblies 54,54' also have a means 64,64' for vibrating the respective screed plate assemblies 58,58'. Preferably, a motor driven shaft having an eccentric mass attached thereto is mounted directly on each of the screed plate assemblies. Also, the platform assemblies preferably have a conventional tamper bar mounted forwardly, in the direction of machine travel, of the screed plate assemblies 58,58'. The tamper bars are driven by a motor in a substantially up-and-down vertical motion to provide initial compaction to paving material deposited on a roadway surface ahead of the screed assembly 10.

The platform assemblies 54,54' also have a means 68,68' for heating the material contacting surfaces 60,60' to prevent sticking of paving material to the surfaces. Typically, the means 68,68' for heating the material contacting surfaces comprises a burner assembly and associated ducts to direct hot air from the burner assembly onto the upper surface of the plate providing the material contacting surface 60,60'.

Each of the modular screed assemblies 14,14' also have a means 70,70' for moving the movable carriage 28,28' between a first, or retracted, position at which the modular screed assemblies are adjacent the main screed unit 12 and a second, or extended, position at which the modular screed assemblies are spaced from the main screed unit, as shown in FIGS. 1 and 2. Preferably the means 70,70' for moving the movable carriage comprises a first hydraulic cylinder 72,72'mounted on a respective support assembly 16,16' and has an extendable rod end 74,74' that is attached to the outer end member 32,32' of the frame 30,30'. Thus, extension or retraction of the extendable rod end 74,74' results in a corresponding extension or retraction of the modular screed assembly 14,14'.

The modular screed assembly 14,14' also has a means 76,76' for selectively positioning the platform assembly 54,54' elevationally with respect to the movable carriage 28,28'. In the preferred embodiment of the present invention, the means 76,76' for selectively positioning the platform assembly includes a second hydraulic cylinder 78,78' and a third hydraulic cylinder 80,80', each having an extendable rod end 82,82',84,84', respectively. The second and third hydraulic cylinders 78,78',80,80' are arranged vertically on the modular screed assemblies and are preferably attached directly to the frame 30,30'. The respective rod ends 82,82',84,84' of the cylinders are pivotally connected to the platform assembly 54,54'.

A controlled flow of pressurized fluid is provided to each of the first, second and third hydraulic cylinders 72,72',78,78',80,80', through high pressure flexible hoses, not shown. Preferably, the hoses fitted with quick disconnect couplings on their respective ends to further enhance the serviceability of the extensible modular screed units 14,14' separate from main screed unit 12.

INDUSTRIAL APPLICABILITY

The present invention is particularly useful in carrying out asphalt paving operations in which it is desired to vary the width of a pavement mat simultaneously with a change in slope of a portion of the laid down mat. For example, it is often desirable to pave, or lay down, a roadway shoulder in the same operation with the main traffic lanes. Typically, the shoulder portion of the roadway has a different slope than the main lanes. Furthermore, the width of the shoulder portion typically varies at intersections with other roadways or ramps.

In the present invention, the width of the pavement mat is determined by the respective position of at least one of the modular screed units 14,14'. Lateral movement of the modular units with respect to the main screed is carried out by extending or retracting the extendable rod end 74,74' of the respective first hydraulic cylinder 72,72' In the fully retracted position, a modular unit will be positioned adjacent the main screed 12, i.e., immediately behind the main screed, thereby providing a pavement mat having a width substantially the same as that of the main screed unit. In the fully extended position, the modular units are laterally spaced, outwardly, from the main screed unit, as shown in FIGS. 1 and 2. At the extended position the screed assembly 10 will provide a mat having a width substantially the same as that of the combined width of the main and modular screed units.

In the modular screed assemblies 14,14', the elevational position of the deck members 56,56', and hence the elevational position of the screed plate assemblies 58,58', is determined by the position of the extendable rod ends 82,82',84,84'. Thus, extending or retracting the extendable rod ends 82,82',84,84' will move a respective end of the material contacting surfaces 60,60' relative to a corresponding carriage 28,28' of the modular assembly.

The position of the extendable rod ends of the first, second and third hydraulic cylinders 72,72',78,78',80,80' is controlled by pressurized hydraulic fluid which is directed to the cylinders in the manner well known in the hydraulic art. Further, as known in the electronic arts, the respective position of each of the rod ends may be sensed by sensors that provide a signal which may be compared with a desired value and, if required, generate corrective signals to control the flow of hydraulic fluid to a selected pressure chamber of the hydraulic cylinders.

It can also be easily appreciated that one, or both, of the modular screed assemblies 14,14' may be readily detached from the main screed 12 by unfastening the bolts 18,18' which secure the support assemblies 16,16' to the main frame. This feature permits removal of an extendable unit if required for repair or service. Furthermore, the modular units may be easily added to an existing fixed width main screed unit to convert the fixed width screed to a variable width screed.

Other aspects, objects and advantages of this invention cam be obtained from a study of the drawings, the disclosure, and the appended claims.

What is claimed is:

1. A modular screed assembly attachment for an asphalt paving machine having a main screed unit, said modular screed assembly comprising:

a support assembly detachably connectable to said main screed unit in a predetermined fixed relationship with respect to said main screed unit;

a movable carriage slidably mounted on said support assembly in horizontally adjustable and elevationally fixed relationships with respect to said support assembly;

a platform assembly connected to said movable carriage in selectively variable elevational relationship with respect to said carriage;

means for moving said movable carriage between a first position adjacent said main screed unit and a second position horizontally spaced from said main screed unit; and means for selectively positioning said platform assembly elevationally with respect to said carriage.

2. A modular screed assembly attachment, as set forth in claim 1, wherein said means for moving said movable carriage includes a first hydraulic cylinder having an extendable rod end, said first cylinder being mounted on said support assembly and said movable rod end being connected to said movable carriage.

3. A modular screed assembly attachment, as set forth in claim 1, wherein said means for selectively positioning said platform assembly elevationally with respect to said carriage includes a second and a third hydraulic cylinder each having a respective movable rod end, each of said second and third cylinders being respectively mounted on said movable carriage and said movable rod ends being respectively connected to said platform assembly.

4. A modular screed assembly attachment, as set forth in claim 1, wherein said movable carriage includes a frame having spaced apart end members, and a pair of guide members having opposed end portions, each of said guide members being attached at each of said opposed end portions to a respective one of said end members of said frame.

5. A modular screed assembly attachment, as set forth in claim 4, wherein said support assembly includes a pair of internal surfaces each defining a bore, said bores being adapted to slidably receive a respective one of said guide members.

6. A modular screed assembly attachment, as set forth in claim 1, wherein said platform assembly includes a deck member and a screed plate assembly having a paving material contacting surface, said screed plate being detachably connected in vibration isolating relationship to said deck member.

7. A modular screed assembly attachment, as set forth in claim 6, wherein said platform assembly includes means for vibrating said screed plate assembly.

8. A modular screed assembly attachment, as set forth in claim 1, wherein said platform assembly includes a tamper bar and a motor operatively connected to said tamper bar, said tamper bar being movable in a substantially vertical direction.

9. A modular screed assembly attachment, as set forth in claim 6, wherein said platform assembly includes means for heating said material contacting surface.

10. A screen assembly for an asphalt paving machine comprising:

a main screed unit;

a pair of modular screed units each having a support assembly detachably connected to said main screed unit, a movable carriage slidably mounted on said support assembly in horizontally adjustable and elevationally fixed relationship with respect to said main screed unit, a platform assembly movably connected to said carriage in selectively variable elevational relationship with respect to said carriage, means for moving said carriage between a first position adjacent said main screed unit and a second position horizontally spaced from said main screed unit, and means for selectively positioning said platform assembly elevationally with respect to said carriage.

11. A screed assembly, as set forth claim 10, wherein said means for selectively positioning said platform assembly elevationally with respect to said carriage includes a pair of hydraulic cylinders having a movable rod end, said cylinders being respectively mounted on said movable carriage and said movable rod ends being respectively connected to said platform.

12. A screed assembly, as set forth in claim 10, wherein said platform includes a deck member and a screed plate having a paving material contact surface, said screed plate being detachably connected in vibration isolating relationship to said deck member.

13. A screed assembly, as set forth in claim 12, wherein said platform includes means for vibrating said screed plate.

14. A screed assembly, as set forth in claim 10, wherein said platform assembly includes a tamper bar and a motor operatively connected to said tamper bar, said tamper bar being movable in a substantially vertical direction.

15. A screed assembly, as set forth in claim 12, wherein said platform assembly includes means for heating said material contacting surface.

* * * * *